US006942579B2

(12) United States Patent
Chen

(10) Patent No.: US 6,942,579 B2
(45) Date of Patent: Sep. 13, 2005

(54) MULTI-FUNCTION GOLF TRAINING DEVICE

(76) Inventor: David Chen, No. 1598, Jungshan Rd., Shengang Shiang, Taichung (TW), 429

( * ) Notice: Subject to any disclaimer, the term of this patent is extended or adjusted under 35 U.S.C. 154(b) by 0 days.

(21) Appl. No.: 10/653,205

(22) Filed: Sep. 3, 2003

(65) Prior Publication Data

US 2005/0049059 A1 Mar. 3, 2005

(51) Int. Cl.[7] ..... A63B 69/36
(52) U.S. Cl. ..... 473/161
(58) Field of Search ..... 473/157–166, 473/170–172, 194–197

(56) References Cited

U.S. PATENT DOCUMENTS 1,612,291 A * 12/1926 Jackson ..... 473/160
3,595,581 A * 7/1971 Anderson et al. ..... 473/161
4,222,568 A * 9/1980 Russo ..... 473/160
4,790,538 A * 12/1988 Gettelfinger ..... 473/161
5,123,651 A * 6/1992 Vinciguerra ..... 473/163
5,301,947 A * 4/1994 Kim ..... 473/153
6,050,901 A * 4/2000 Davis ..... 473/160
6,062,984 A * 5/2000 Ju ..... 473/160
6,146,284 A * 11/2000 Russell ..... 473/160
6,497,625 B2 * 12/2002 Newby ..... 473/163
6,569,027 B2 * 5/2003 Florian ..... 473/160

* cited by examiner

*Primary Examiner*—Mark S. Graham
(74) *Attorney, Agent, or Firm*—Browdy and Neimark, PLLC

(57) ABSTRACT

A multi-function golf training device, including: a base member; at least three of elevating assemblies nonlinearly provided on the base member, each elevating assembly having a elevating part that can be forced up or down by external power. A putting green board pivots on those elevating parts of those elevating assemblies and the sloping degree and direction can be adjusted by moving those elevating parts up or down. The putting green board includes a ball cavity for the golf ball. The base member has a wall around three sides, a vent at one side, and a recess in the center area that connects with the ball trench by a guide way.

12 Claims, 14 Drawing Sheets

MULTI-FUNCTION GOLF TRAINING DEVICE

BACKGROUND OF THE INVENTION

1. Field of the Invention

The present invention relates to a golf training device, and more particularly to a multi-function golf training device for training putting and approaching skills.

2. Description of the Related Art

U.S. patent application Ser. No. 10/420821 in the name of the present inventor discloses three automatically elevating assemblies provided on the bottom of the base member. These three automatically elevating assemblies can define a plate and can be adjusted by a controller or by programming to change the sloping degree of the putting green. By the way, this will make the training more fun and challenging. Also the user can adjust the sloping degree of the putting green to a special degree for a particular purpose.

But, even though the prior art had been disclosed with the excellent structures, the cost of the production is still too high, however, which makes this prior art invention not popular.

SUMMARY OF THE INVENTION

The primary objective of the present invention is to provide a golf training device, which can adjust, up or down, the sloping degree of the putting green easily and reduce the cost of production.

According to the objective of the present invention, a golf training device comprise a base member, at least three elevating assemblies provided on the base member and each of the elevating assemblies has a elevating part that can be forced up or down by external power, a putting green board pivots on those elevating parts of those elevating assemblies, wherein the sloping degree of the putting green can be adjusted by moving these elevating parts, the putting green includes a ball cavity for the golf ball and the outside of the base member includes a wall around the base member and a vent, the base member has a recess for the ball cavity of the putting green, a ball trench arranged on the base member and beside the putting green and a guide way connects the ball trench and the recess.

DETAILED DESCRIPTION OF THE INVENTION

Figure 1:
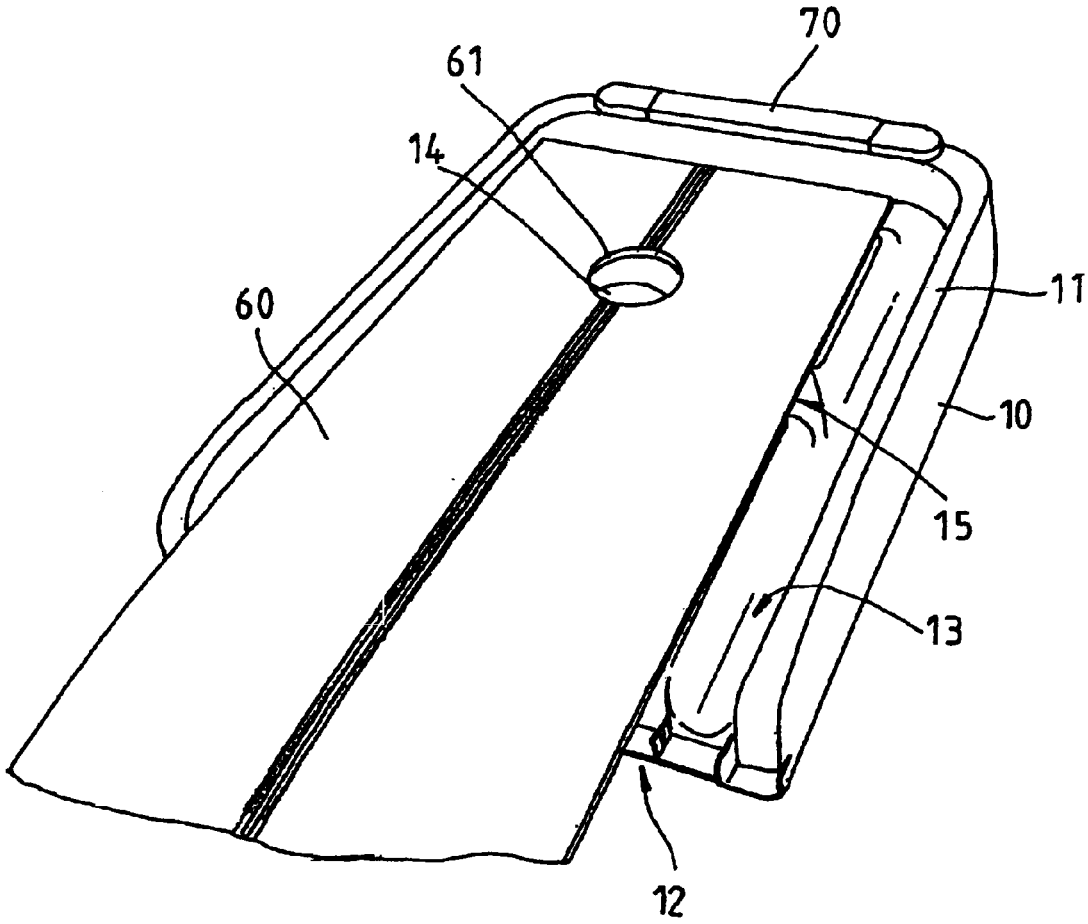
FIG. 1 is a perspective view of the first preferred embodiment of the present invention.
Figure 2:
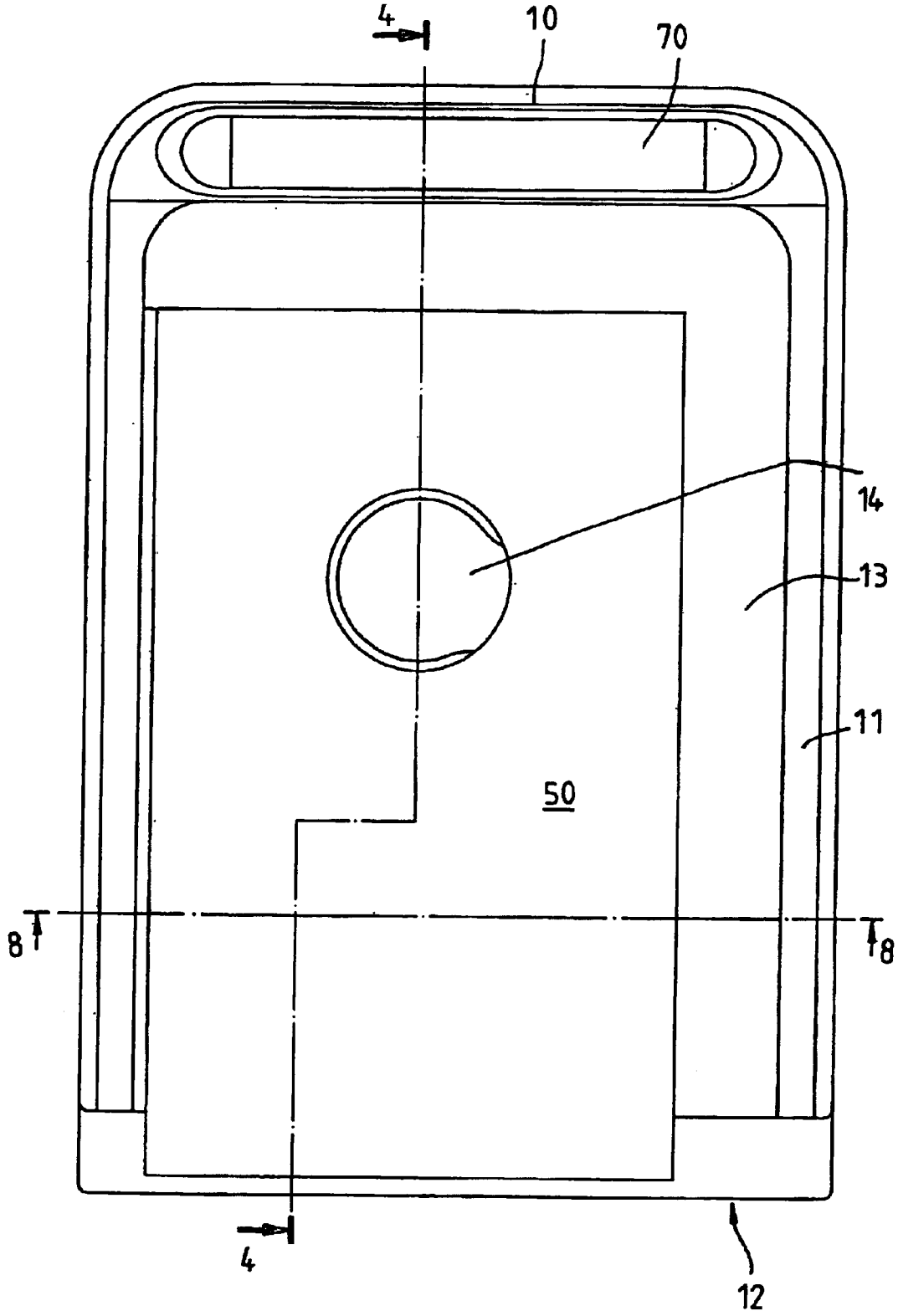
FIG. 2 is a top view of FIG. 1 without the divot.
Figure 3:
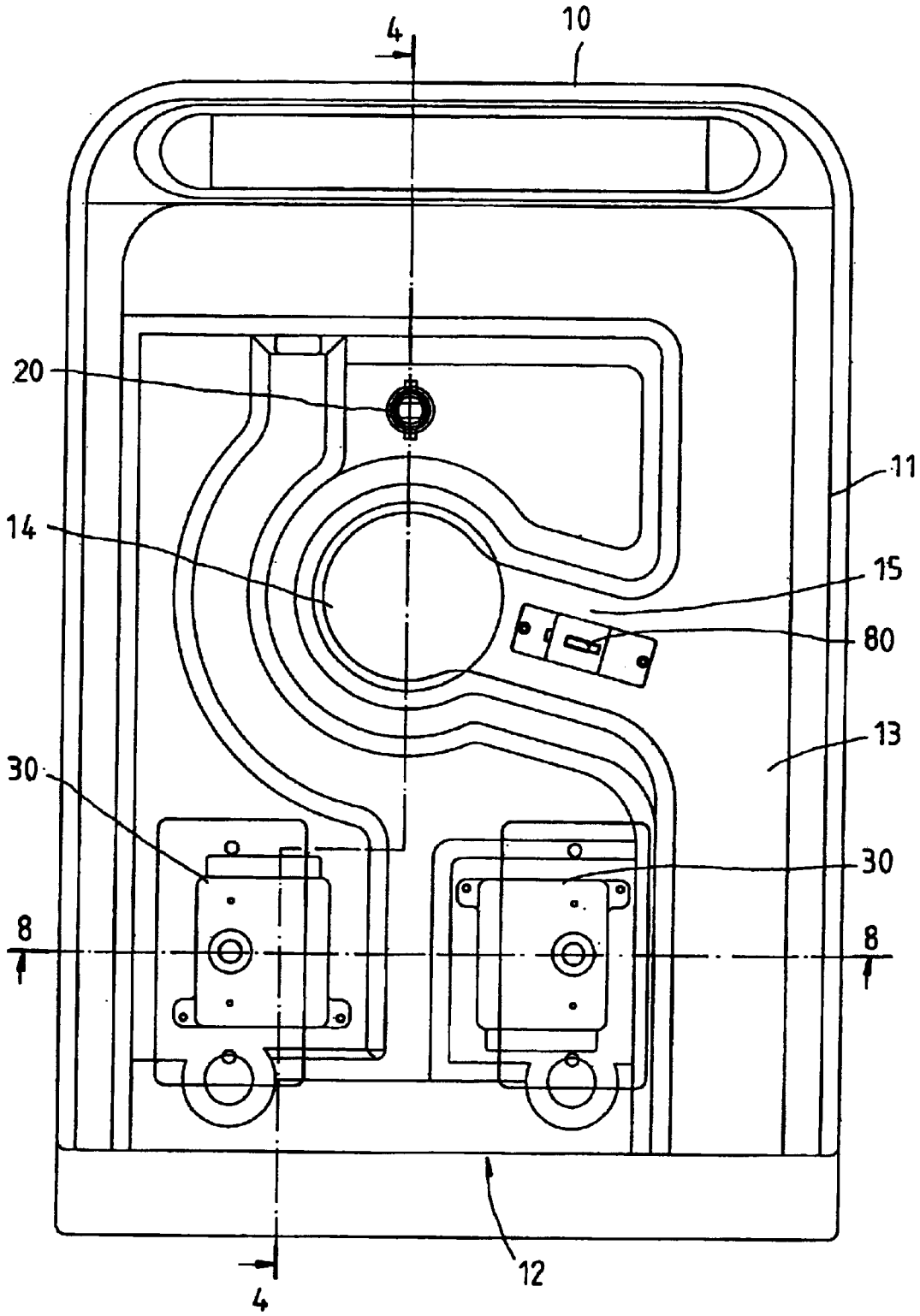
FIG. 3 is a top view of FIG. 2 without the putting green board.

FIG. 1 to FIG. 4 show a golf training device of the first preferred embodiment of the present invention.

A base member 10 in orthogonal shape has a wall 11 around three sides thereof, a vent 12 at one side, and an L-shaped ball trench 13 arranged beside the wall 11 forming the vent 12. Said base member 10 has a recess 14 in the center area and connects with the ball trench 13 by a guide way 15.

There are three elevating assemblies nonlinearly provided on said base member 10. There are an artificial elevating assembly 20 and two automatically elevating assemblies 30 in the first embodiment of present invention. Each elevating assembly has a elevating part 25, 32, respectively, that can be forced up or down by external power. These structures and actions will be discussed hereafter.

A putting green board 50 pivots on those elevating parts 25, 32 of those elevating assemblies and the sloping degree and direction can be adjusted by moving those elevating parts up or down. Said putting green board includes a ball cavity 51 for the recess 14 of the base member.

An elongated alley 60 sits on the putting green board 50 and has a hole 61 for the ball cavity 51.

A control device 70 that is a set of circuitry is provided on the base member 10 to control those automatically elevating assemblies.

A microswitch 80 sits in the guide way 15. Said microswitch will give a signal to the control device 70 for counting the point when the golf ball runs over it.

Figure 4:
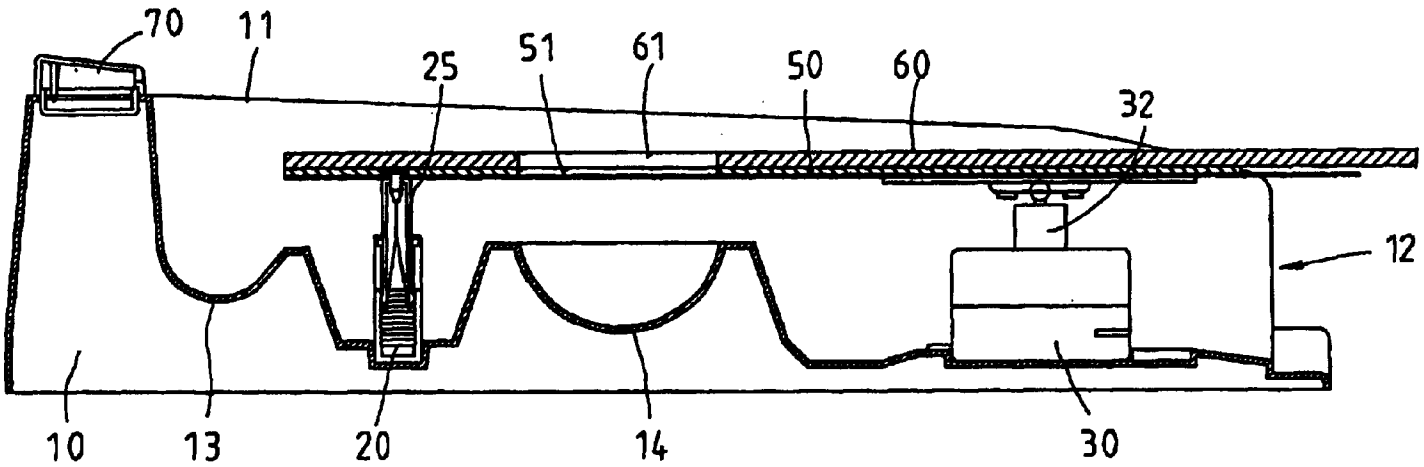
FIG. 4 is a sectional view along the 4—4 line in FIG. 2 shows the putting green board in the horizontal posture.

FIG. 4 shows the device of the first embodiment of present invention in the highest horizontal position.

Figure 5:
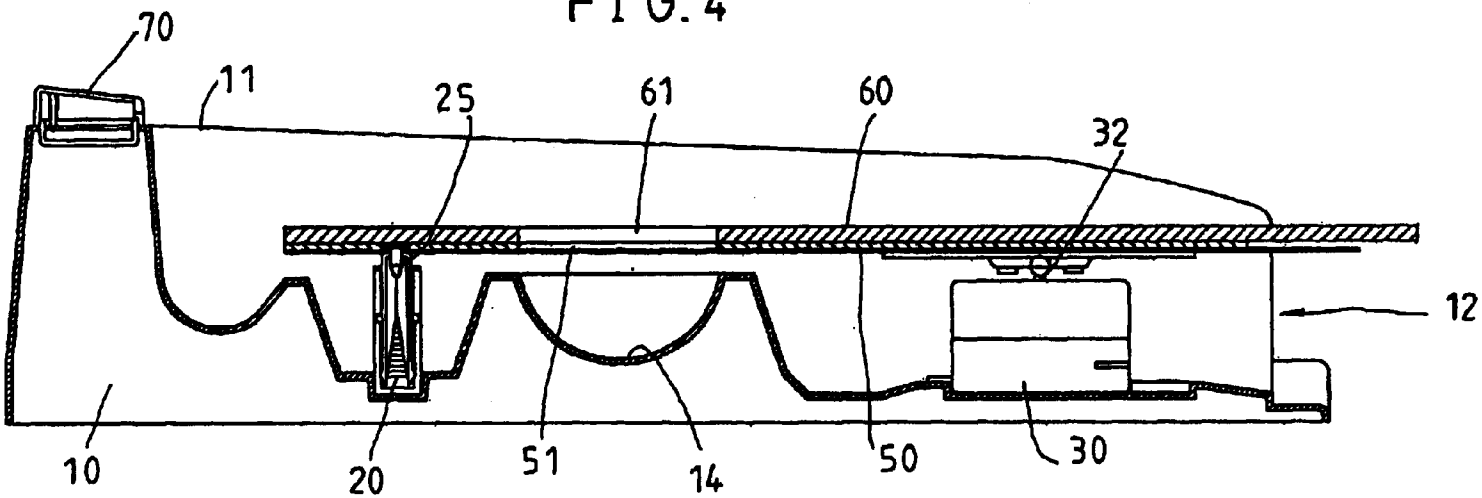
FIG. 5 is a sectional view as FIG. 4 shows the putting green board in the lowest position of the horizontal posture.

FIG. 5 shows the device of the first embodiment of present invention in the lowest horizontal position.

Figure 6:
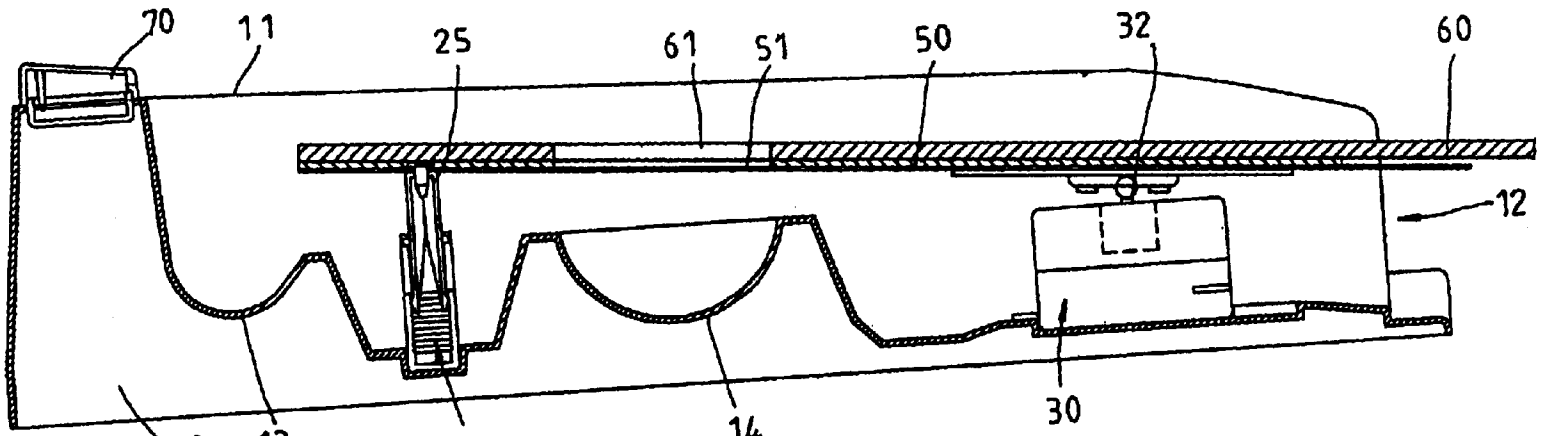
FIG. 6 is a sectional view as FIG. 4 shows the putting green board in the upward posture.

FIG. 6 shows the artificial elevating assembly 20 in the highest position and the automatically elevating assemblies 30 in the lowest positions. The putting green board is inclined downwardly from the back to the vent 12 for upward putting practice.

Figure 7:
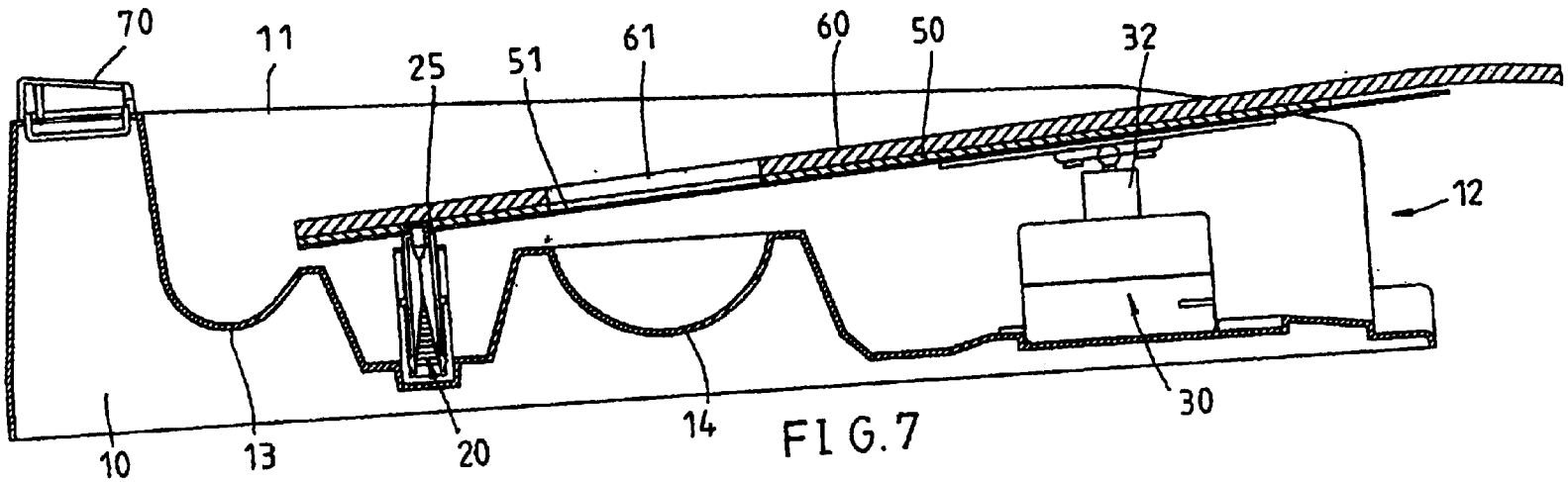
FIG. 7 is a sectional view as FIG. 4 shows the putting green board in the downward posture.

FIG. 7 shows the artificial elevating assembly 20 in the lowest position and the automatically elevating assemblies 30 in the highest positions. The putting green board is inclined downwardly from the vent 12 to the back for downward putting practice.

Figure 8:
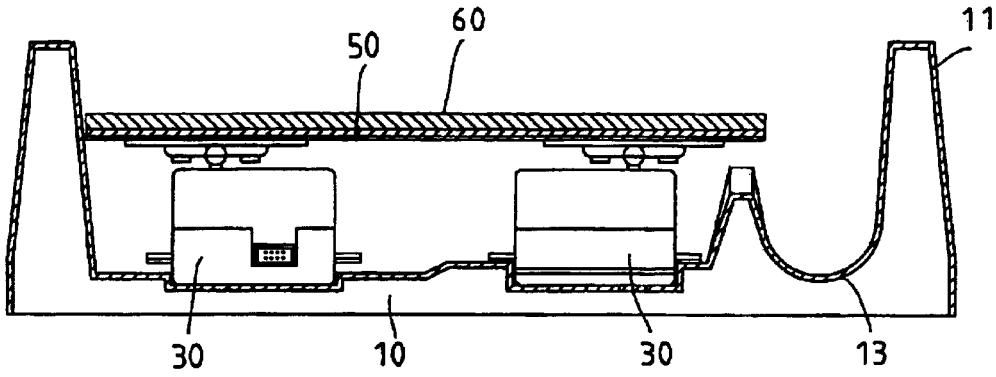
FIG. 8 is a sectional view along the line 8—8 in FIG. 2 shows two elevating assemblies in the lowest position of the horizontal posture.

FIG. 8 shows the automatically elevating assemblies 30 both in the lowest position and the putting green board is in the horizontal posture.

Figure 9:
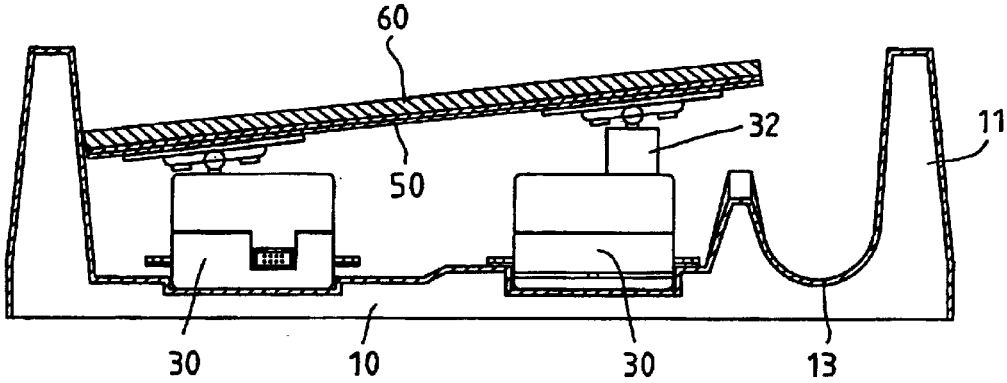
FIG. 9 is a view of FIG. 8 showing the putting green board inclined to the left side.

FIG. 9 shows the automatically elevating assembly 30 at the left side in the lowest position and the automatically elevating assembly 30 at the right side in the highest position and the putting green board 50 is inclined to the left side.

Figure 10:
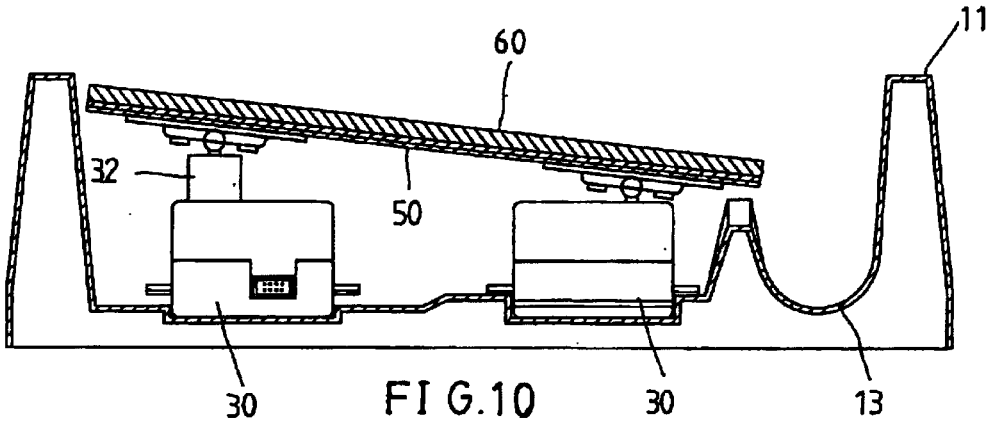
FIG. 10 is a view of FIG. 8 showing the putting green board inclined to the right side.

FIG. 10 shows the automatically elevating assembly 30 at the left side in the highest position and the automatically elevating assembly 30 at the right side in the lowest position and the putting green board 50 is inclined to the right side.

These two automatically elevating assemblies 30 can control the sloping degree and direction of the putting green board 50 and the degree and direction can be changed into many different practice types by using the artificial elevating assembly 20.

As shown from FIG. 11 to FIG. 15, is construction of the artificial elevating assembly 20 of the first embodiment of present invention.

A shell 21 is provided on the base member 10 at one end by studs 22 and a long chase 23 is provided downward on the shell from the top. There are many annular flutings 24 provided on the inside wall of the meta-long chase 23.

An elevating part 25 has two flexible arms 26 and receives the arms 26 in the long chase 23. Said elevating part is slidable and positionable by the flexible arms 26 and the fluting 24. The fore part of the shell 21 has two limitative parts 27 that are two long holes. Said elevating part 25 has two tappets 28 which are received in the long hole 27 to make an uppermost stop position and a lowermost stop position for the elevating part 25.

A connector 29 goes through a hole that is pre-set on the putting green board and fixes on the top of the elevating part 25.

Figure 12:
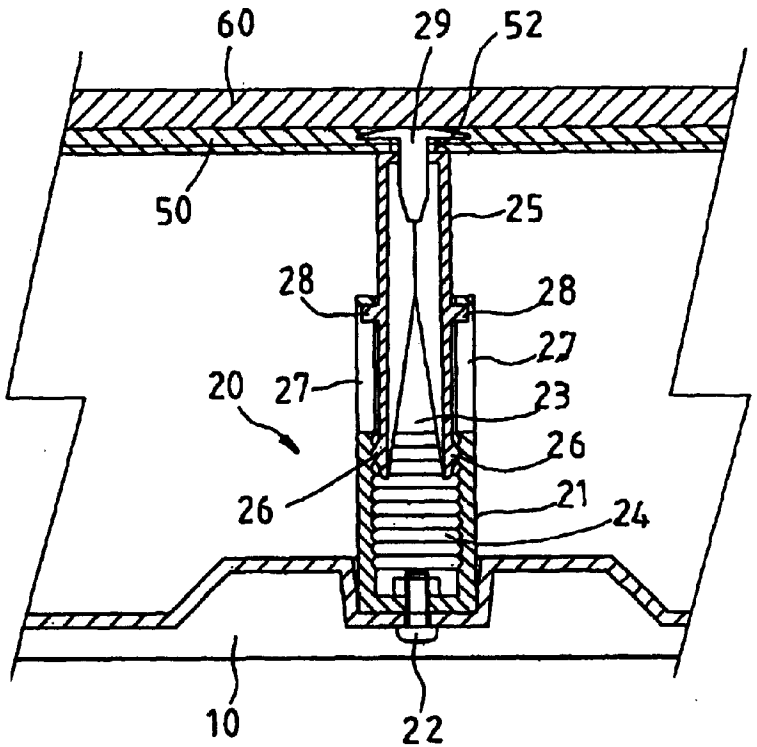
FIG. 12 is a sectional view along the line 12—12 in FIG. 11.
Figure 11:
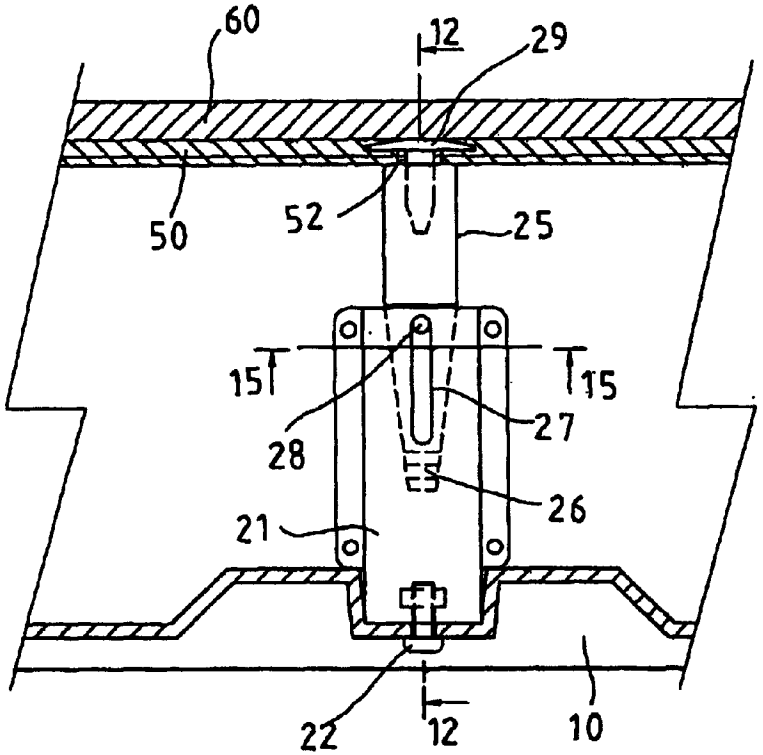
FIG. 11 is a perspective view of the artificial elevating assembly structures of the first preferred embodiment of the present invention shown in the highest position.

FIG. 11 and FIG. 12 show the elevating part 25 in the uppermost stop position.

Figure 14:
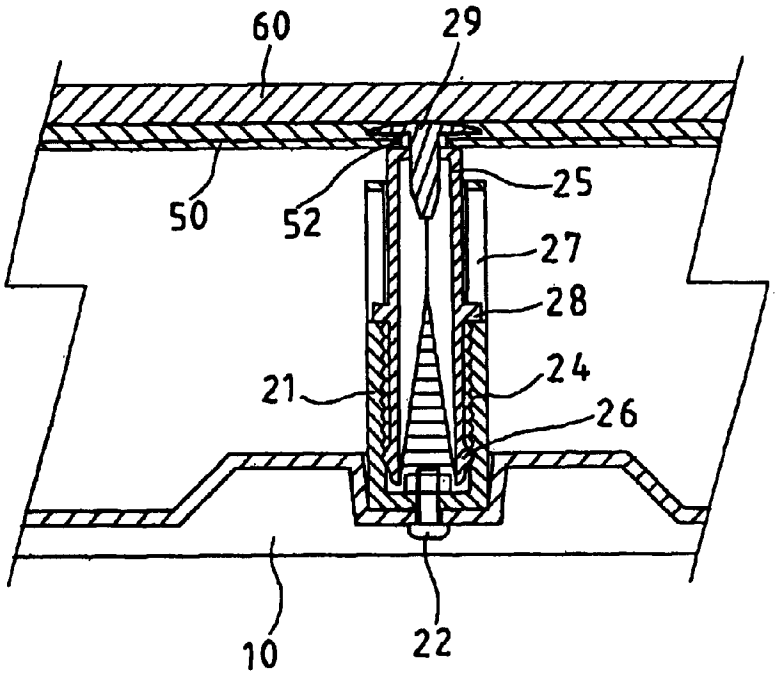
FIG. 14 is a sectional view along the line 14—14 in FIG. 13.
Figure 13:
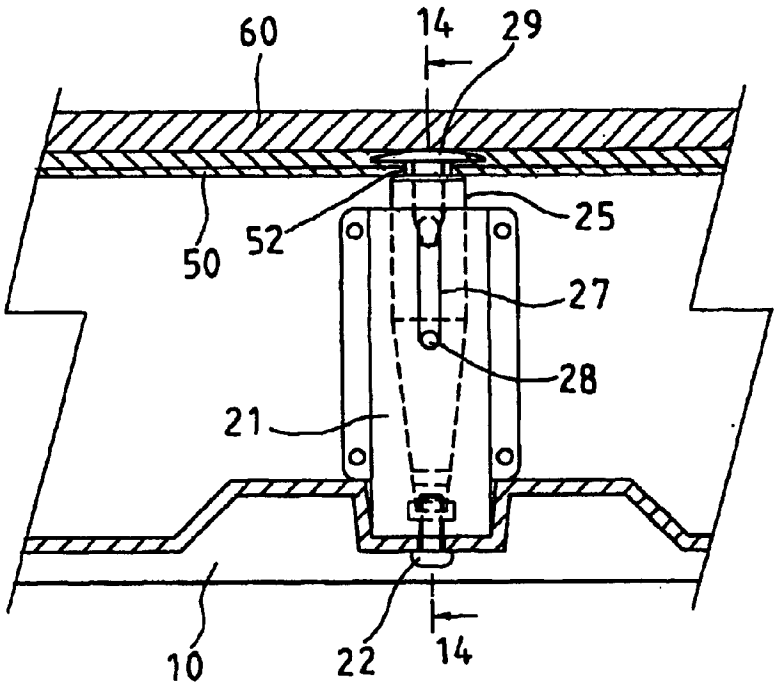
FIG. 13 is a view as FIG. 11 shows the artificial elevating assembly in the lowest position.
Figure 15:
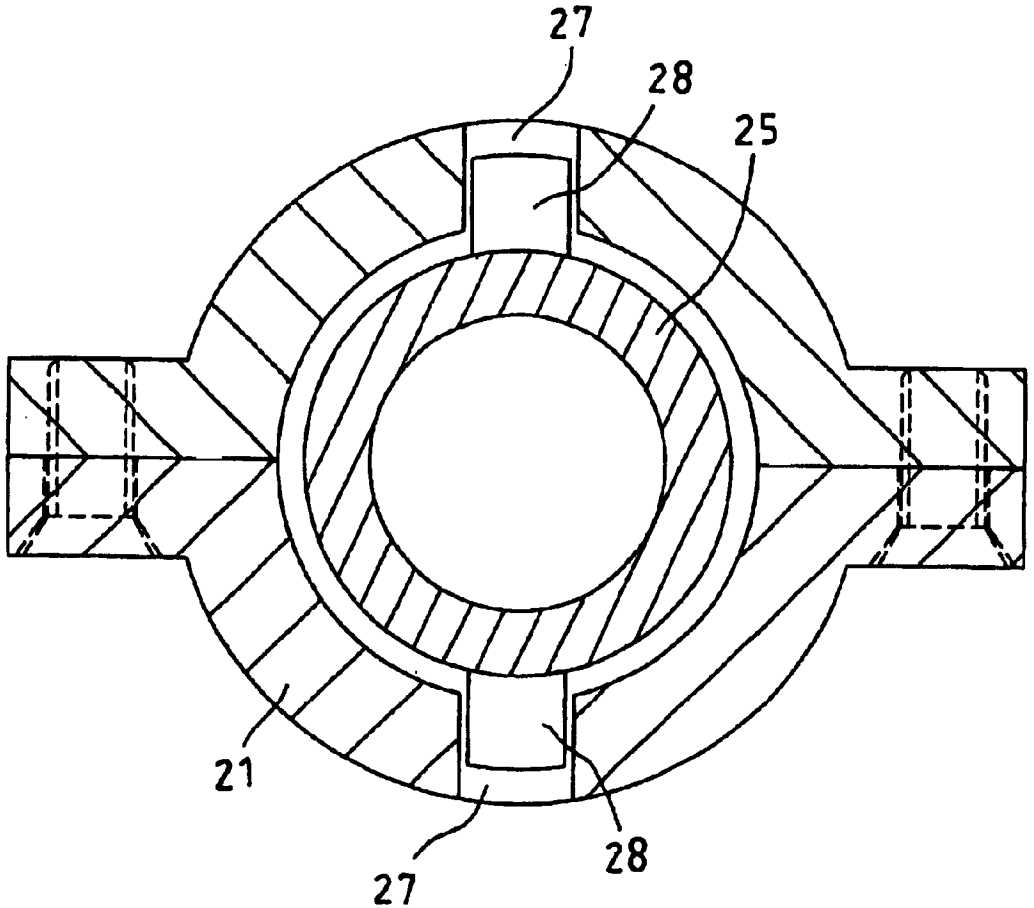
FIG. 15 is a sectional view along the line 15—15 in FIG. 11.

FIG. 13 and FIG. 14 show the elevating part 25 in the lowermost stop position.

FIG. 16 to FIG. 20 show the automatically elevating assemblies 30 of the first embodiment of present invention, including shell 31;

An elevating part 32 having a tubular shape is provided on the shell 31 and a rib 33 is provided on the outside of the elevating part 32 to avoid rotation of the elevating part 32 and threads are provided on the inside wall of the elevating part 32 (not shown).

A pivot 35 is provided, with threads 36 on the inside wall which correspond to the threads on the inside wall of the elevating part 32, which pivots (or rotates) in the shell 31.

A motor 37 has an endless screw 38 for meshing with a worm wheel 39 to cause a small gear 41 and a large gear 42 to rotate and to cause the pivot 35 to rotate also.

A rotator 43 is fixed on the top of the elevating part 32 by a stud 44.

A receiver 45 is fixed on the bottom of the putting green board by studs 46 and holds said rotator 43.

An elastic part 47 is provided on one side of the pivot 35 and an umbo 48 is provided at the bottom of the pivot 35. Said umbo 48 can press the elastic part 47 to touch a metal point 49 to pass a electric signal for counting the number of rotations of the pivot 35 and controlling the height of the elevating part 32.

Figure 16:
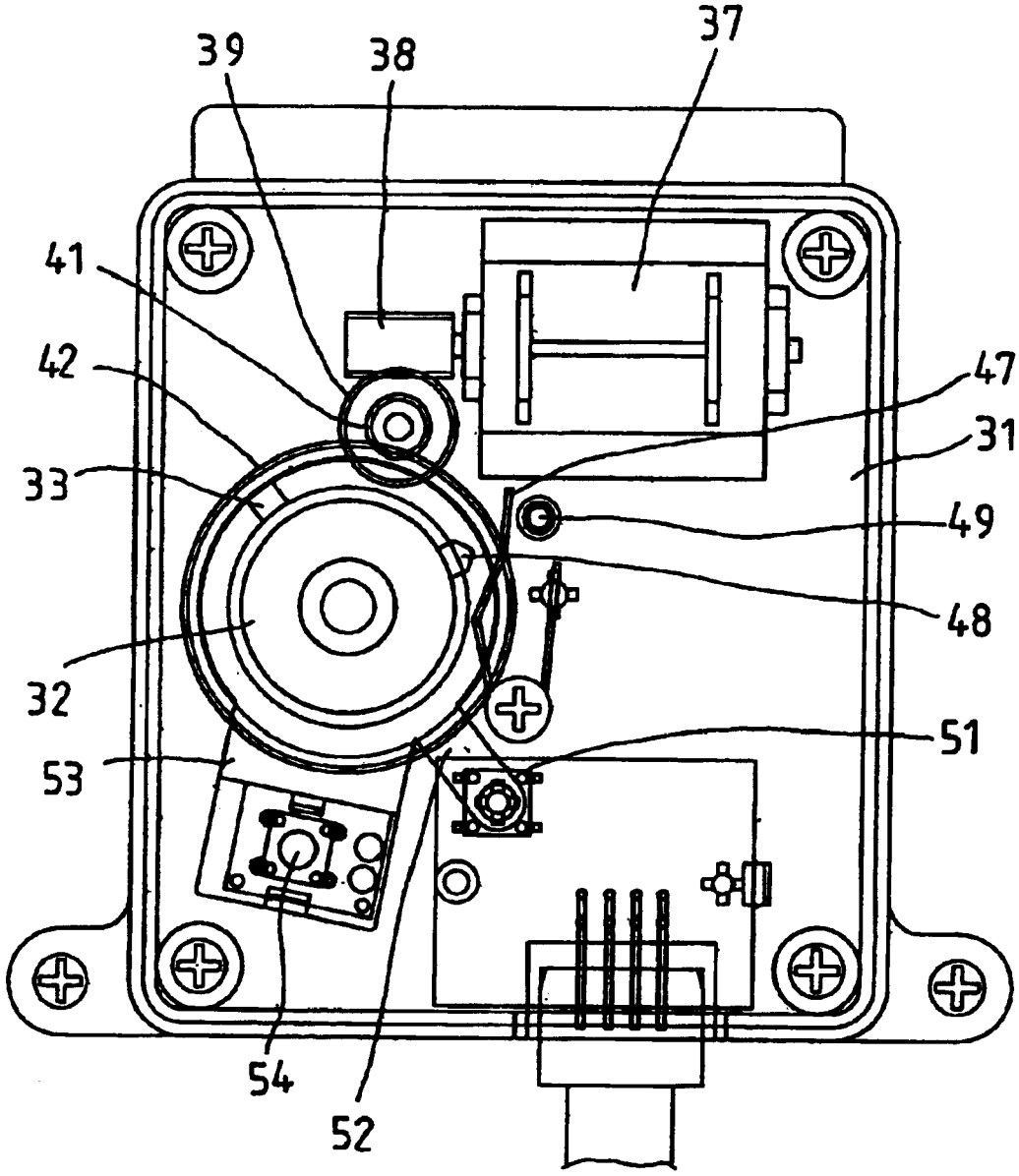
FIG. 16 is a top view of the automatically elevating assembly structures of the first preferred embodiment of the present invention.
Figure 17:
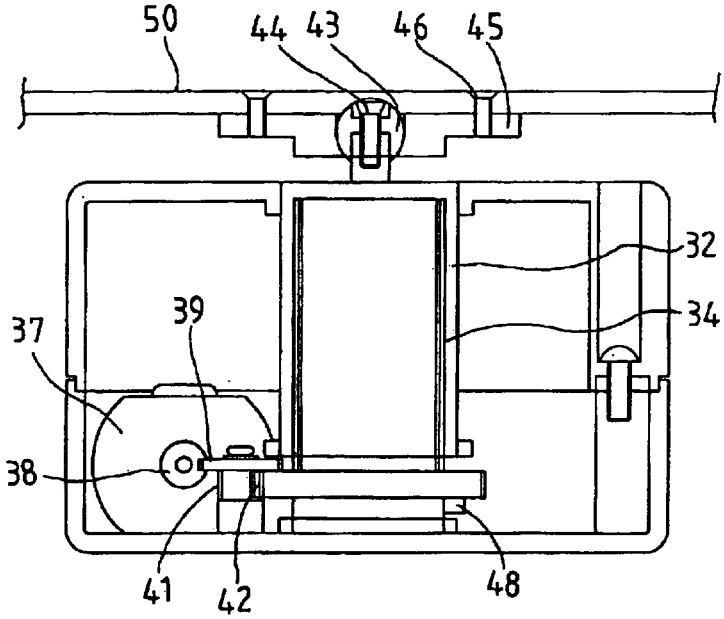
FIG. 17 is a side view of the automatically elevating assembly structures shows in the lowest position.
Figure 18:
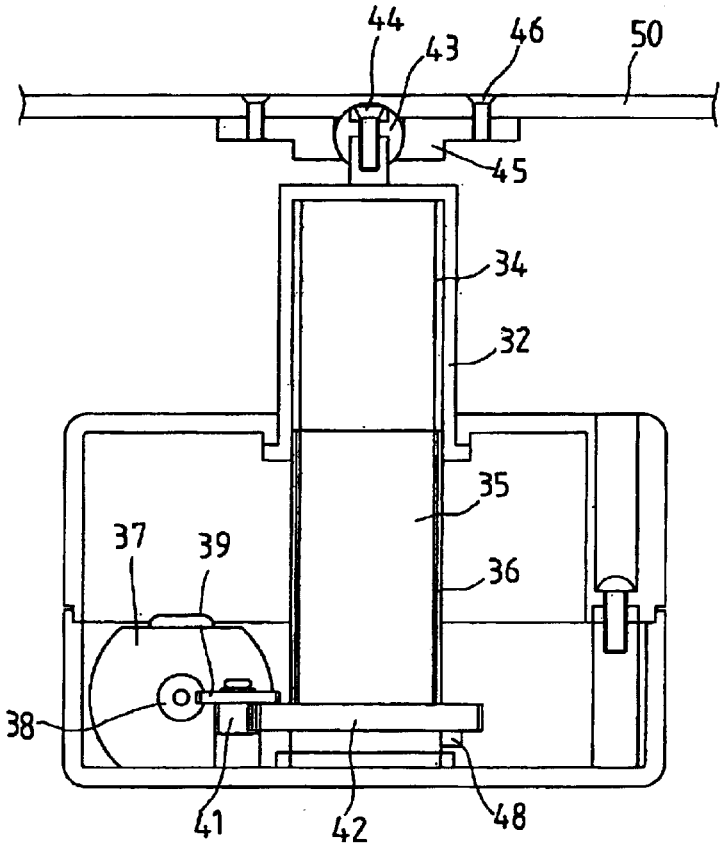
FIG. 18 is a view of FIG. 17 shown in the highest position.
Figure 19:
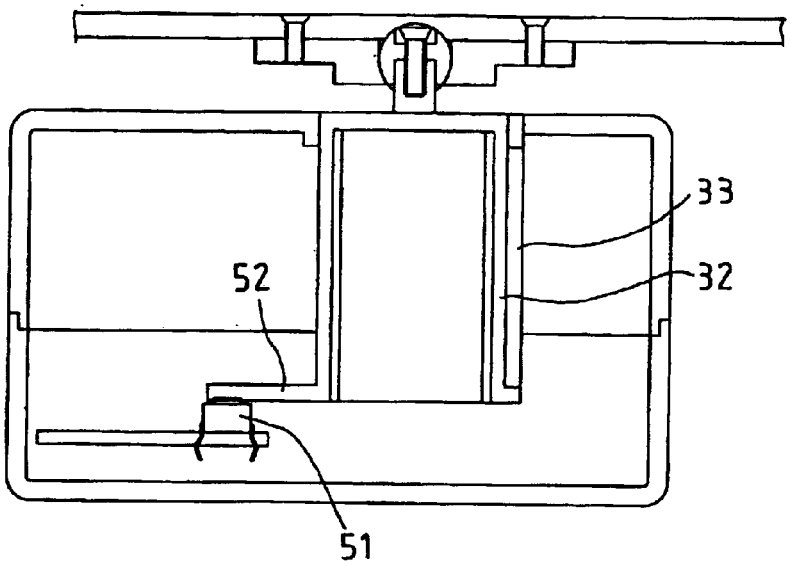
FIG. 19 is another side view of the automatically elevating assembly structures shown in the lowest position.
Figure 20:
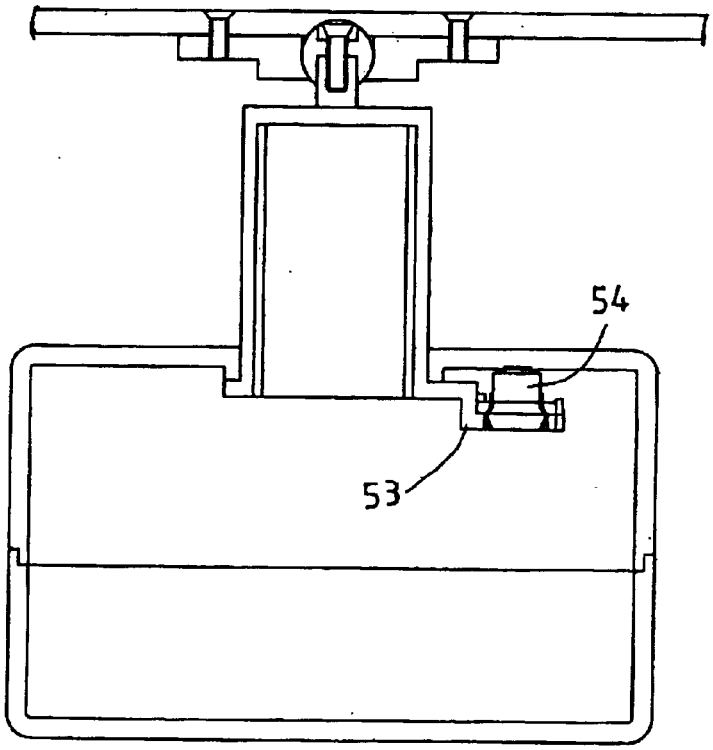
FIG. 20 is another side view of the automatically elevating assembly structures shown in the highest position.

Additionally, a microswitch 51 is provided at the lowermost stop position of said shell 31 as shown in FIG. 16 and FIG. 19 and a press arm 52 is provided at the bottom of the elevating part 32. The microswitch 51 will send a signal to stop the motor 37 when the elevating part 32 goes down to the lowermost stop position and makes the press arm 52 touch the microswitch 51. As shown in FIG. 16 and FIG. 20, there is a bearing base 53 provided at the bottom of the elevating part 32 and a microswitch 54 provided on said bearing base 53 for the uppermost stop position. When the elevating part goes up to the uppermost stop position, the microswitch 54 will touch the outer wall of the shell 31 and send a signal to stop the motor 37. Said two switches are safety switches and these switches need not always be provided in contrast to the counting function.

Figure 21:
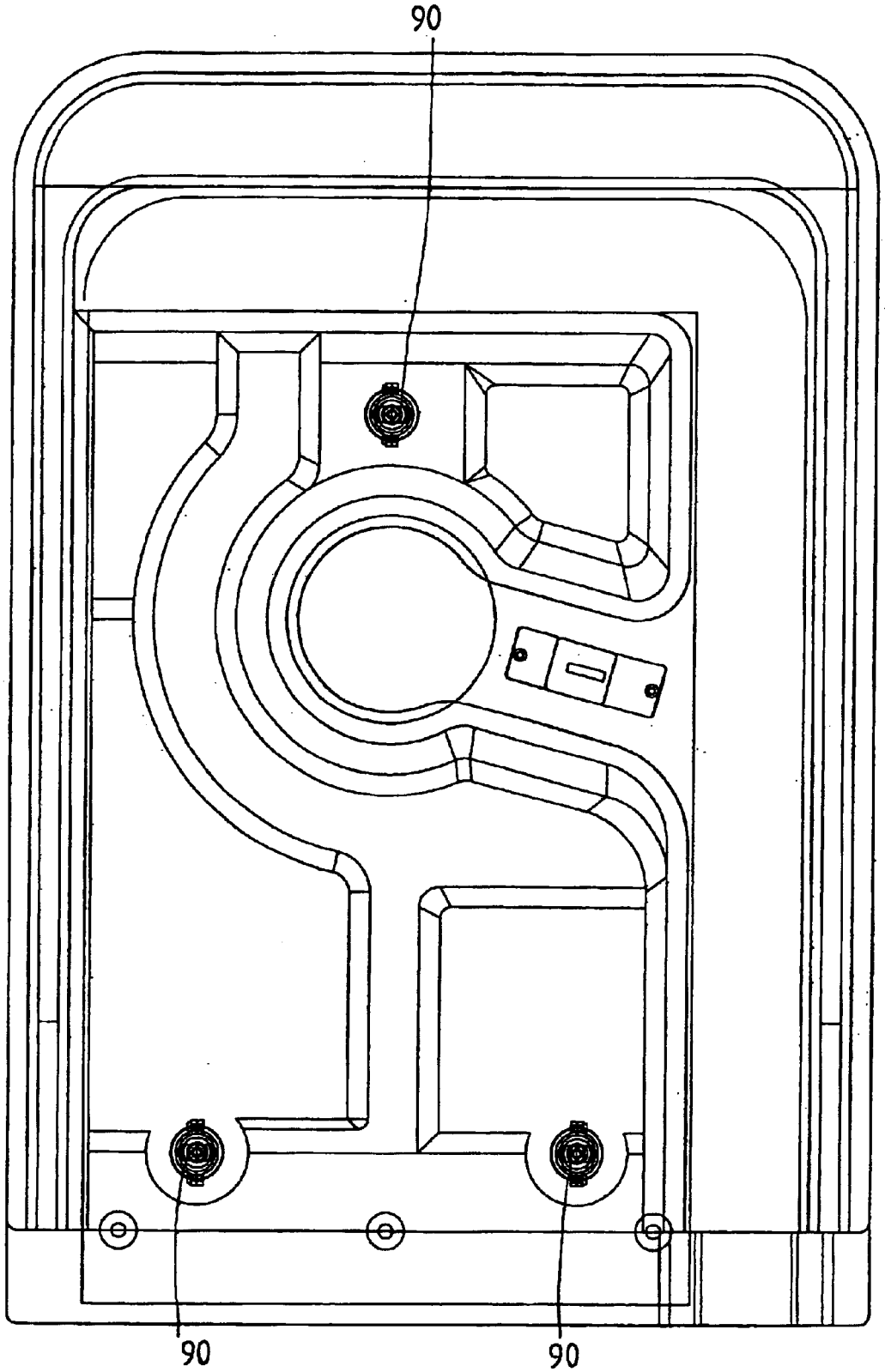
FIG. 21 and FIG. 22 are the section views of the second embodiment of present invention.
Figure 22:
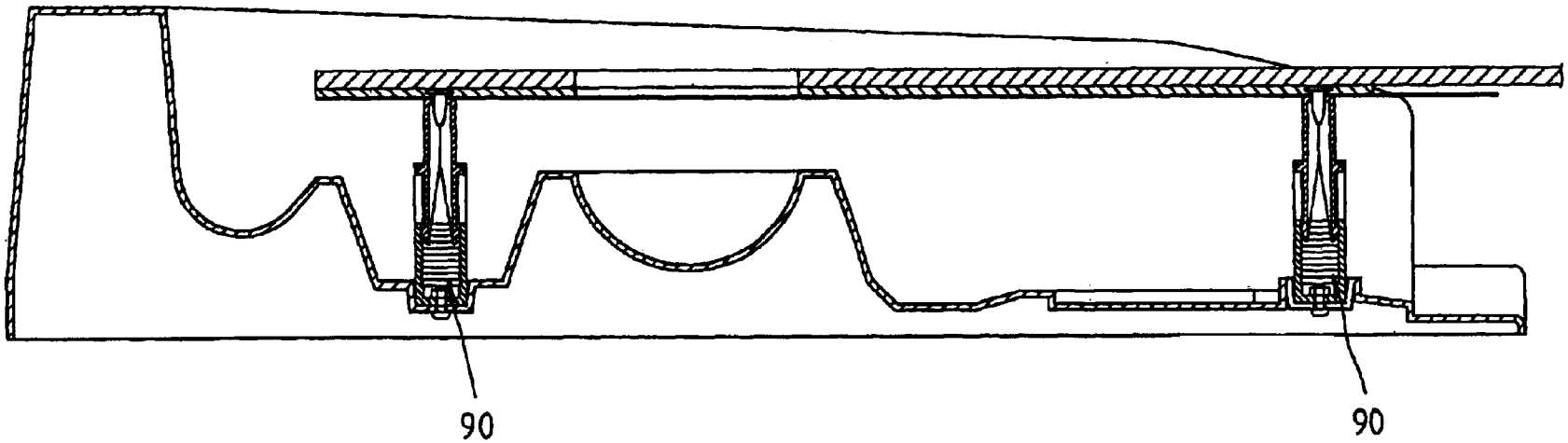

The device as shown in FIG. 21 and FIG. 22 is the second embodiment of present invention and three of the elevating assemblies are all artificial elevating assemblies therein for the user to adjust the sloping degree and direction of the putting green board by hand.

What is claimed is:

1. A multi-function golf training device, comprising:

a base member;

at least three elevating assemblies nonlinearly provided on said base member, each elevating assembly having a elevating part that can be forced up or down by external power;

a unitary putting green board connected so as to pivot on the elevating parts of the elevating assemblies such that a sloping degree and direction of the board is adjustable by moving the elevating parts up or down, said putting green board comprising a ball cavity for the golf ball; and said base member having an outer wall around three sides, a vent at one side, a ball trench arranged beside the wall, and a recess in the center area which connects with the ball trench by a guide way, and wherein the at least three elevating assemblies are connected between the base member and the putting green board and each elevating assembly is operable independently of the other elevating assemblies wherein the elevating assemblies include an artificial elevating assembly and two automatically elevating assemblies, and wherein said artificial elevating assembly comprises a shell provided on the base member and a elevating part slideable and positionable so as to rotate in the shell, and wherein one of the shell or the elevating part has a chase and the other has at least one flexible arm that is received in the chase.

2. The golf training device as defined in claim 1, wherein the two automatically elevating assemblies are provided near to the vent.

3. The golf training device as defined in claim 1, wherein one of the shell or the elevating part has a limitative part and the other has a tappet for engagement with the limitative part to make an uppermost stop position and a lowermost stop position.

4. The golf training device as defined in claim 3, wherein said limitative part is a long hole and said tappet is received in said long hole.

5. The golf training device as defined in claim 1, wherein each automatically elevating assembly comprises a shell, an elevating part that is provided on the shell, and a motor that can force the elevating part move up or down by a gear set.

6. The golf training device as defined in claim 1, comprising three artificial elevating assemblies therein.

7. A multi-function golf training device, comprising:

a base member;

at least three elevating assemblies nonlinearly provided on said base member, each elevating assembly having a elevating part that can be forced up or down by external power;

a unitary putting green board connected so as to pivot on the elevating parts of the elevating assemblies such that a sloping degree and direction of the board is adjustable by moving the elevating parts up or down, said putting green board comprising a ball cavity for the golf ball; and said base member having an outer wall around three sides, a vent at one side, a ball trench arranged beside the wall, and a recess in the center area which connects with the ball trench by a guide way, and wherein the at least three elevating assemblies are connected between the base member and the putting green board and each elevating assembly is operable independently of the other elevating assemblies, and wherein the elevating assemblies include an artificial elevating assembly and two automatically elevating assemblies, and wherein each automatically elevating assembly comprises a shell, an elevating part that is provided on the shell, and a motor that can force the elevating part move up or down by a gear set, and wherein said gear set comprises a pivot that rotates in the shell and connects with said elevating part.

8. The golf training device as defined in either claim 5 or claim 7, wherein the gear set comprising an endless screw and a worm wheel.

9. The go training device as defined in either claim 5 or claim 7, wherein said shell comprises two microswitches, and when the elevating part moves to the uppermost stop position or lowermost stop position, an appropriate one of the microswitches will send a signal to stop the motor.

10. The golf training device as defined in either claim 5 or claim 7, wherein said shell comprises a counting device for direct or indirect counting or the number of rotations of the motor.

11. The golf training device as defined in one of claim 1 claim 5 or claim 7, further comprising a controlling device to control the automatically elevating assemblies.

12. The golf training device as defined in claim 11, wherein said base member comprises a microswitch that sits in the guide way.

* * * * *